US005797517A

United States Patent [19]

Weinstein

[11] Patent Number: 5,797,517

[45] Date of Patent: Aug. 25, 1998

[54] LIQUID PUMP DISPENSER WITH TRI-PURPOSE NOZZLE

[75] Inventor: Jack Weinstein, Manchester Township Ocean County, N.J.

[73] Assignee: Primary Delivery Systems, Inc., Easton, Pa.

[21] Appl. No.: 738,336

[22] Filed: Oct. 25, 1996

[51] Int. Cl.[6] ..... B65D 35/28

[52] U.S. Cl. ..... 222/95; 222/105; 222/321.9; 222/383.3

[58] Field of Search ..... 222/95, 105, 321.9, 222/340, 383.3, 382, 536

[56] References Cited

U.S. PATENT DOCUMENTS

| | | | |
|---|---|---|---|
| 2,033,312 | 3/1936 | Welker . | |
| 2,536,277 | 1/1951 | Grieme . | |
| 2,625,304 | 2/1953 | Mart . | |
| 2,880,914 | 4/1959 | Lerner . | |
| 3,162,333 | 12/1964 | Davidson . | |
| 3,840,153 | 10/1974 | Devlin . | |
| 4,164,305 | 8/1979 | Haggerty . | |
| 4,274,562 | 6/1981 | Medeiros . | |
| 4,362,256 | 12/1982 | Polasek . | |
| 4,858,792 | 8/1989 | de Laforcade . | |
| 4,938,393 | 7/1990 | Ericson et al. | 222/383.3 |
| 5,065,900 | 11/1991 | Pino . | |
| 5,180,085 | 1/1993 | Schimid . | |
| 5,242,079 | 9/1993 | Stephens . | |
| 5,267,674 | 12/1993 | von Schuckmann . | |

FOREIGN PATENT DOCUMENTS

| | | | |
|---|---|---|---|
| 3529659 | 2/1987 | Germany | 222/321.9 |

*Primary Examiner*—Philippe Derakshani
*Attorney, Agent, or Firm*—Kenneth P. Glynn

[57] ABSTRACT

A dispenser has a hollow housing with sidewalls, a base and a top. The top has a cylinder for receiving piston, and a catch for permitting limited movement of the piston within the cylinder. The piston having an inlet valve for allowing air into the cylinder. The cylinder has an outlet valve which forces air into the housing. The dispenser has a tri-purpose nozzle. The nozzle has a dispensing orifice at one end and is biased in an open up position. The piston is suspended from the bottom surface of the nozzle. As such, the nozzle acts as the pump for slidably moving the piston within the cylinder. The top has a fluid outlet port opposite the position of the cylinder. The nozzle is rotatably connected to the top. In addition, there is a structure for fluidly connecting the fluid outlet port to the nozzle. That is, when the nozzle is pumped downward, the nozzle is aligned with the fluid outlet port via the structure for fluidly connecting so as to permit a fluid to travel from the housing, through the fluid outlet port, through the structure for fluidly connecting, through the nozzle and out the dispensing orifice. When the nozzle springs back to its resting position, the nozzle and fluid outlet port are not in alignment, thereby preventing air and fluid from flowing out the housing. The nozzle and structure for fluidly connecting thus acting as a valve.

20 Claims, 1 Drawing Sheet

LIQUID PUMP DISPENSER WITH TRI-PURPOSE NOZZLE

BACKGROUND OF THE INVENTION

1. Field of the Invention

The present invention is directed to dispensers and, specifically to dispensers which are utilized to advance viscous liquids, gels, and the like, out of the dispenser at rates and times desired by the user. More specifically, the present invention is directed to a dispenser which involves a unique tri-purpose nozzle which functions as a handle for a pump, as a dispenser and as a valve at a joint.

2. Prior Art Statement

Numerous dispensers have been developed over the years and date back more than half a century. They have been developed for many purposes and have diverse mechanisms of operation. Various types of tubes and dispensers have been developed to advance liquids, gels and like.

U.S. Pat. No. 2,033,312 to A. H. Welker describes a combined faucet and air pump. for liquid containers. The invention incorporates a faucet and an air pump into a single unit, where the pump and faucet will be alternately operable and simultaneously inoperable to prevent leakage. The faucet can be secured to the container and tightened in any position desired in relation to the tap, which can be used in any depth container. It can be sealed and broken only by breaking the seal. The pump coacts with a half cover to form a handle grip when the spout and pump are sealed in a closed position.

U.S. Pat. No. 2,536,277 to W. Grieme describes a flat leakproof oiler. The invention is a non-leaking oiler which has a pump and spout that seals itself when the spout is in a non-spouting position. The spout can swing to, any position and can be easily housed in a non-oiling position such that it does not protrude dangerously.

U.S. Pat. No. 2,625,304 to H. A. Mart describes a fuel dispensing device with rotatable nozzle communicating with venting and liquid dispensing openings. The invention provides means for venting a container when the nozzle is moved from an on to an off position.

U.S. Pat. No. 2,880,914 to L. L. Lerner et al. describes a dispenser which is mounted on a container for dispensing fluent materials. The device includes a spring-loaded pump, where the spring is shielded from the fluent material.

U.S. Pat. No. 3,162,333 to E. Davidson describes a pump which has a pump body comprised of a resilient material. One wall is sufficiently resilient to be depressible for producing pressure changes. The pump body has a base opening which communicated with the pumping chamber. The base member is inserted in the base opening to close off the pumping chamber and includes an intake conduit having an one-way valve. The pump body has an outlet passage which leads to a discharge spout.

U.S. Pat. No. 3,840,153 to Edward J. Devlin describes a drinking utensil which has flexible walls and a conduit extending from the main body. A valve is applied to the conduit to control the flow of the liquid.

U.S. Pat. No. 4,164,305 to Dennis A. Haggerty describes a closure for use in a spout and cap combination, wherein the closure allows for ease in opening and closing. An air/liquid mixing chamber is located adjacent to and communicates with the spout. A liquid passage and air passage are provided in the cap to convey said items to the mixing chamber.

U.S. Pat. No. 4,274,562 to Davis E. Medeiros describes a slidable valve for dispensing from an insulated bottle. The container has a pump which generates air pressure over the liquid, forcing removable thereof. A valve functions to prevent accidental discharge and prevents creation of air pressure over liquid.

U.S. Pat. No. 4,362,256 to Randolph J. Polasek describes a beverage tap. It creates air pressure over the container to which it is attached and allows for dispensing thereof.

U.S. Pat. No. 4,858,792 to Vincent de Laforcade describes a storage and dispensing unit which has a separate dispensing head. The dispensing head can be attached to the container for fluid communication and eventual discharge of the fluid.

U.S. Pat. No. 5,065,909 to Giovanni Pino describes a vented beverage can cover having a pivotal spout. The invention has a cap having a cap with an outlet passage and a vent and valve. The valve has a tubular lever which puts it in communication with the outlet passage to form a mouthpiece. The valve also opens the vent.

U.S. Pat. No. 5,180,085 to Hans G. Schmid describes a container which has a bladder within. A pump is provided which pumps air into the bladder. As bladder expands, it squeezes liquid into spray chamber, where it mixes with air and out the nozzle.

U.S. Pat. No. 5,242,079 to Ruth A. Stephens describes a cover for an opened beverage container. It has a pivoted valve in the withdrawal passage, which is opened/closed by action of the tubular spout integral with the valve. The spout has a ball-ended vent plug engageable with a vent opening in the cover.

U.S. Pat. No. 5,267,674 to Alfred von Schuckmann describes a container for spray dispensing having a handle for a pump, the pump having a piston rod, and a piston cylinder. The pump cylinder has a pressure relief opening which can be moved over by the sealing surface of a cuff which forms the pump piston. The opening is in communication with an outwardly open tube cross section of the piston rod when the pump piston is in depressed position.

Thus, notwithstanding the formidable prior art, there seems to be no teaching of the present invention which utilizes a tri-purpose nozzle to act as a handle for pumping air into the container, act as the dispensing nozzle and also act as a valve at a joint.

SUMMARY OF THE INVENTION

The present invention involves a dispenser. The dispenser has a hollow housing with sidewalls, a base and a top. The top has a cylinder for receiving a piston, and a catch for permitting limited movement of the piston within the cylinder. The piston plate has an one-way inlet valve which allows air into the cylinder when the piston moves up. The cylinder has an outlet valve which forces air into the housing. The dispenser has a tri-purpose nozzle. The nozzle has a dispensing orifice at one end and is biased in an upwardly position. The piston is suspended from the bottom surface of the nozzle. As such, the nozzle acts as the pump for slidably moving the piston within the cylinder. The top has a fluid outlet port opposite the position of the cylinder. The nozzle is rotatably connected to the top. In addition, there is a means for fluidly connecting the fluid outlet port to the nozzle. That is, when the nozzle is pumped downward, the nozzle is aligned with the fluid outlet port via the means for fluidly connecting so as to permit a fluid to travel from the housing, through the fluid outlet port, through the means for fluidly connecting, through the nozzle and out the dispensing orifice. When the nozzle springs back to its resting position, the nozzle and fluid outlet port are not in alignment, thereby preventing air and fluid from flowing out the housing. The nozzle and means for fluidly connecting thus act as a valve.

BRIEF DESCRIPTION OF THE DRAWINGS

The present invention will be more fully understood when the disclosure set forth in the specification herein is taken in conjunction with the drawings appended hereto. Those drawings are.

DETAILED DESCRIPTION OF THE PRESENT INVENTION

The present invention is directed to a dispenser which delivers a metered amount of substance to the user after every actuation of the tri-purpose nozzle. It is superior to the prior art dispensers due to its particular construction and design, as well as its unique function. The present invention device includes a tri-purpose nozzle which operates in three ways, as a handle for the pump, as a dispenser and as a valve at a joint. Throughout the detailed description, identical parts are identically numbered.

Figure 1:
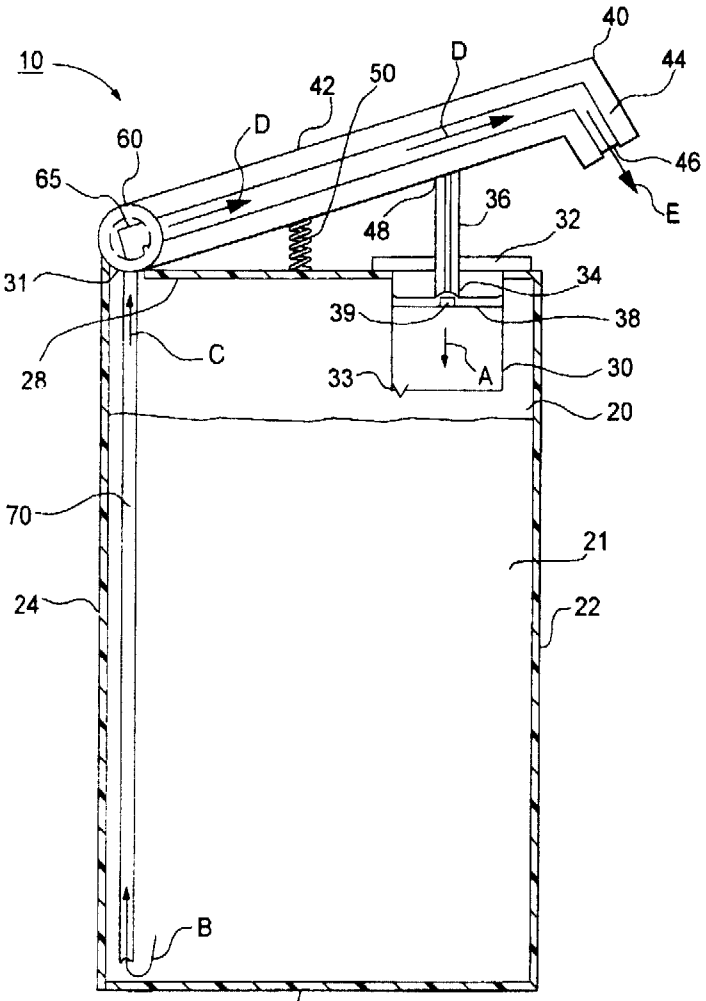
FIG. 1 shows a side cross sectional view of an embodiment of the present invention.

Referring to FIG. 1, there is shown a side cross sectional view of a dispenser 10. Structurally, dispenser 10 includes a main hollow housing 20, a nozzle 40 and an elbow joint 60. Although elbow joint 60 is shown in the preferred embodiment, any device which permits a rotatable connection, as explained below, can be used. In addition, nozzle 40 is meant to mean any tubular device which transports fluid from one place to another. Main hollow housing 20, nozzle 40, elbow joint 60 and other similar parts can be constructed from plastics, extruded or otherwise, metals and/or other suitable materials.

Although in FIG. 1, main hollow housing 20 is described and shown as a rectangular container, dispenser 20 can be cylindrical and/or any other shape in which a fluid 21 can be contained. In the embodiment shown, main hollow housing 20 has side walls 22, and 24, a base 26, and a top 28. Top 28 has a fluid outlet port 31 on one end of dispenser 10. Top 28 is configured to have a cylinder 30 and a catch 32 for receiving a piston 34 on an end opposite fluid outlet port 31. Piston 34 has a shaft 36 and a push plate 38. Push plate 38 further has an one-way inlet valve 39 which allows air into cylinder 30 when piston 34 moves up. Inlet valve 39 is preferably of the ball check type, but other one-way valves can be used. Catch 32 permits shaft 36 to move push plate 38 up and down within cylinder 30. Cylinder 30 has an outlet valve 33 which forces air into the main hollow housing 20. Outlet valve 33 permits air to be forcefully directed into main hollow housing 20, but does not permit reverse flow. That is, outlet valve 33 is an one way valve.

Nozzle 40 preferably has an elongated portion 42 and a bent portion 44. Bent portion 44 further includes a dispensing orifice 46 through which a fluid 21 is dispensed to the user. In addition, nozzle 40 is positioned with respect to top 28, such that it can act as a pump for piston 34 and cylinder 30. That is, shaft 36 is attached to a lower surface 48 of nozzle 40. A spring 50 biases nozzle 40 in an upwardly position with respect to top 28.

Elbow joint 60 rotatably connects nozzle 40 to main hollow housing 20 and is located on top 28 in alignment with fluid outlet port 31. Elbow joint 60 permits nozzle 40 to be pumped in a downward manner relative to top 28. Nozzle 40 is also connected to fluid outlet port 31 via a fluid connector 65. Implementation of fluid connector 65 can be accomplished in two ways. First, fluid connector 65 can be an integral part of nozzle 40. As such, elbow joint 60 is adapted to hold fluid connector 65. Alternatively, fluid connector 65 can be an integral part of elbow joint 60. In either case, when nozzle 40 is pumped downward, fluid connector 65 will permit fluid 21 to flow from fluid outlet port 31 through nozzle 40 and out dispensing orifice 46. This is accomplished because actuation of nozzle 40 forces fluid connector 65 to align itself with fluid outlet port 31 and release fluid 21 through dispensing orifice 46. In a biased upward position, nozzle 40 will result in misalignment of fluid connector 65 with fluid outlet port 31 and prevent air and fluid from flowing out main hollow housing 20. As such, nozzle 40 acts as a valve at fluid outlet port 31.

Figure 2:
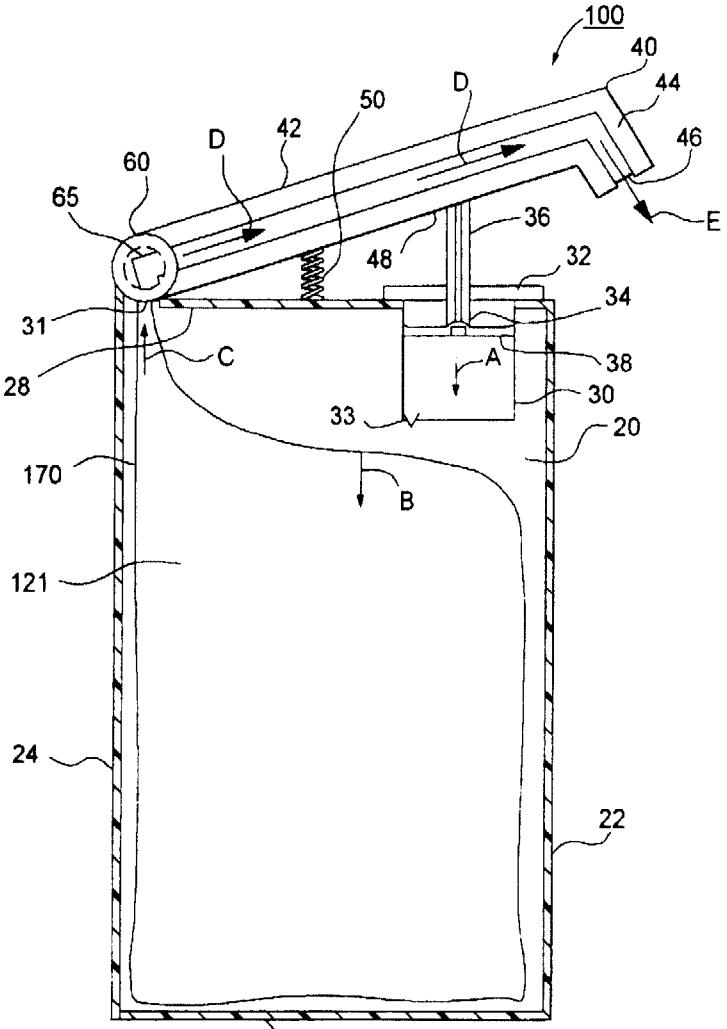
FIG. 2 shows a side cross sectional view of another embodiment of the present invention.

In the embodiment shown in FIG. 1, a dip tube 70 is connected to fluid outlet port 31. When piston 34 forces air into main hollow housing 20, the fluid is driven up dip tube 70 through the rest of the aforementioned pathway. Referring to FIG. 2, where identical parts are identically numbered, a pouch or bag 170 is used to hold fluid 121 in a dispenser 100. In the same manner as above, forced air will drive the fluid from pouch 170 and eventually out through dispensing orifice 46.

Referring now to FIG. 1 (but applicable also to FIG. 2), a functional description is now given of dispenser 10. In a normal upwardly biased position (first position), nozzle 40 acts as a valve with respect to fluid outlet port 31. This prevents the release of air and fluid when dispenser 10 is not being used. When nozzle 40 is used as a pump handle for dispenser 10, piston 34 is driven downwardly as represented by arrow A (second position). This results in a forceful expulsion of air from cylinder 30 through outlet valve 33. The resulting air pressure on fluid 21 causes fluid 21 to be forced up dip tube 70 and through fluid outlet port 31 (as represented by arrows B and C). In FIG. 2, the air pressure causes pouch 170 to compress, forcing fluid 121 up into and through fluid outlet port 31. Since nozzle 40 is in a downward position, fluid connector 65 is aligned with fluid outlet port 31. This permits pressurized fluid 21 or 121 to travel through fluid connector 65, through nozzle 40 and eventually out dispensing orifice 46 (as represented by arrows D and E). When nozzle 40 is released and springs backs to the first position, nozzle 40 again acts as a valve at elbow joint 60. Dispenser 10 and/or 100 dispenses the same amount of fluid 21 or 121 each time nozzle 40 is actuated (after initial usage, where air bubbles may exist and lesser amounts dispensed). The amount dispensed is in proportion to the amount and force of air expelled from cylinder 30. As such, the size of cylinder 30 influences the dispensed amount. Therefore the size of cylinder 30 can be adjusted with respect to the usage of dispenser 10 or 100.

Obviously, numerous modifications and variations of the present invention are possible in light of the above teachings. It is therefore understood that within the scope of the appended claims, the invention may be practiced otherwise than as specifically described herein.

What is claimed is:

1. A dispenser, comprising:

(a) a hollow housing having sidewalls, a base and a top;

(b) said top having a cylinder for receiving a piston, said cylinder having a catch for permitting limited movement of said piston within said cylinder and said cylinder further having an outlet valve into said housing;

(c) a nozzle having a dispensing orifice at one end;

(d) means for biasing said nozzle in a first position;

(e) said piston being suspended from a bottom surface of said nozzle, said nozzle being a means for pumping said piston slidably within said cylinder;

(f) a fluid outlet port on said top opposite said cylinder;

(g) means for rotatably connecting said nozzle with respect to said top, said means for rotatably connecting aligned with said fluid outlet port; and (h) means for fluidly connecting said fluid outlet port to said nozzle;

wherein when said nozzle is pumped downward and moved from said first position to a second position, said means for fluidly connecting aligns with said fluid outlet port to permit a fluid to travel from said housing, through said fluid outlet port, through said nozzle and out said dispensing orifice, and when said nozzle springs back to said first position, said means for fluidly connecting is not in alignment with said fluid outlet port, thereby preventing air and said fluid from flowing out said housing, said nozzle and said means for fluidly connecting acting as a valve.

2. The dispenser of claim 1, wherein said means for fluidly connecting is an angled conduit within said means for rotatably connecting.

3. The dispenser of claim 2, wherein said fluid outlet port is connected to a dip tube.

4. The dispenser of claim 3, wherein said means for biasing is a spring.

5. The dispenser of claim 4, wherein said nozzle further includes:

(a) an elongated portion; and (b) a bent portion, said dispensing orifice being at an end of said bent portion.

6. The dispenser of claim 2, wherein said fluid outlet port is connected to a pouch.

7. The dispenser of claim 6, wherein said means for biasing is a spring.

8. The dispenser of claim 7, wherein said nozzle further includes:

(a) an elongated portion; and (b) a bent portion, said dispensing orifice being at an end of said bent portion.

9. The dispenser of claim 1, wherein said means for fluidly connecting is an angled portion connected to said elongated portion and fits within said means for rotatably connecting.

10. The dispenser of claim 9, wherein said fluid outlet port is connected to a dip tube.

11. The dispenser of claim 10, wherein said means for biasing is a spring.

12. The dispenser of claim 11, wherein said nozzle further includes:

(a) an elongated portion; and (b) a bent portion, said dispensing orifice being at an end of said bent portion.

13. The dispenser of claim 10, wherein said fluid outlet port is connected to a pouch.

14. The dispenser of claim 13, wherein said means for biasing is a spring.

15. The dispenser of claim 14, wherein said nozzle further includes:

(a) an elongated portion; and (b) a bent-portion, said dispensing orifice being at an end of said bent portion.

16. A dispenser, comprising:

(a) a hollow housing having sidewalls, a base and a top;

(b) said top having a means for receiving a piston, said means for receiving permitting limited movement of said piston and said means for receiving further having an outlet valve into said housing;

(c) a nozzle ending in a dispensing orifice at one end, said nozzle being a means for pumping said piston;

(d) means for biasing said nozzle in a first position;

(e) said piston being suspended from a bottom surface of said means for pumping;

(f) a fluid outlet port on said top opposite said means for receiving;

(g) means for rotatably connecting said nozzle with respect to said top, said means for rotatably connecting being aligned with said fluid outlet port; and (h) means for fluidly connecting said fluid outlet port to said nozzle;

wherein when said means for pumping is pressed downward and moved from said first position to a second position, said means for fluidly connecting aligns with said fluid outlet port to permit a fluid to travel from said housing, through said fluid outlet port, through said nozzle and out said dispensing orifice, and when said means for pumping springs back to said first position, said means for fluidly connecting is not in alignment with said fluid outlet port, thereby preventing air and said fluid from flowing out said housing, said nozzle and said means for fluidly connecting acting as a valve.

17. The dispenser of claim 2, wherein said fluid outlet port is connected to a dip tube.

18. The dispenser of claim 16, wherein said fluid outlet port is connected to a pouch.

19. The dispenser of claim 16, wherein said nozzle further includes:

(a) an elongated portion; and (b) a bent portion, said dispensing orifice being at an end of said bent portion.

20. The dispenser of claim 16, wherein said means for biasing is a spring.

* * * * *